US006125482A

United States Patent [19]

Foster

[11] Patent Number: 6,125,482

[45] **Date of Patent: *Oct. 3, 2000**

[54] HAND WASHING UNIT

[75] Inventor: Frank Foster, London, United Kingdom

[73] Assignee: H.M.S.I. Limited, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,286

[22] Filed: Jan. 28, 1997

Related U.S. Application Data

[62] Continuation-in-part of application No. 08/516,918, Aug. 18, 1995, abandoned, and a continuation-in-part of application No. 08/244,277, filed as application No. PCT/GB92/02165, Nov. 23, 1992, abandoned.

[30] Foreign Application Priority Data

Nov. 22, 1991 [GB] United Kingdom ..... 9124819
Feb. 12, 1996 [GB] United Kingdom ..... 9602799

[51] Int. Cl.[7] ..... E03C 1/05

[52] U.S. Cl. ..... 4/623; 4/628

[58] Field of Search ..... 4/623, 628, 643, 4/695

[56] References Cited

U.S. PATENT DOCUMENTS

| | | | |
|---|---|---|---|
| 4,398,310 | 8/1983 | Lienhard | 4/623 |
| 4,523,087 | 6/1985 | Benton | 235/379 |
| 5,199,118 | 4/1993 | Cole et al. | 4/623 X |
| 5,261,444 | 11/1993 | Childers | 4/695 X |
| 5,515,555 | 5/1996 | Wormcke | 4/661 X |

FOREIGN PATENT DOCUMENTS

| | | |
|---|---|---|
| 396039 | 11/1990 | European Pat. Off. . |
| 0 758 702 A1 | 2/1997 | European Pat. Off. . |
| WO 93/10311 | 5/1993 | WIPO . |

OTHER PUBLICATIONS

Cover sheet of European Search Report, Sep. 14, 1998, European Patent Application 97310067.0, 1 pg.

*Primary Examiner*—Robert M. Fetsuga
*Attorney, Agent, or Firm*—Morgan & Finnegan, LLP

[57] ABSTRACT

A handwash station comprises a wall mounted cabinet which contains soap and water dispensing means, a proximity sensor and processing circuitry. The processing circuitry controls the dispensing of soap and water in response to signals from the proximity sensor. A count of valid handwashes is incremented only if a user's hand is detected by the proximity sensor at certain key points. The key points comprise at least the start of a last soap dispensing step and the start of a last rinsing water dispensing step. Differential valid handwash count values are stored periodically by the processing circuitry and can be downloaded to a central station for analysis.

29 Claims, 9 Drawing Sheets

HAND WASHING UNIT

This application is a Continuation-in-Part of U.S. Ser. No. 08/516,918 filed on Aug. 18, 1995 abandoned, a Continuation-in-Part of U.S. Ser. No. 08/244,277 filed as PCT/GB92/02165 on Nov. 23, 1992, now abandoned.

FIELD OF THE INVENTION

This invention relates to a device for washing and rinsing hands, and is particularly suitable for use in premises where food is prepared or in other premises where regular hand washing is essential and needs to be monitored, such as in the catering and healthcare industries.

BACKGROUND TO THE INVENTION

Hygiene regulations in premises such as restaurants, shops and factories in which food is handled have become increasingly stringent in recent years. Generally, the management is held responsible for ensuring that all employees wash their hands properly, for example after using the lavatory, before returning to work. It is however difficult for handwashing regulations to be properly enforced unless it can be comprehensively monitored. In particular, although an employee may be seen to visit a wash basin it is difficult to ensure that he does more than run his fingers under the tap. Also, it is difficult to ensure that soap is used during each hand wash, or indeed to provide soap which can be used without the risk of cross-contamination.

Handwashing units are known which include proximity sensors which automatically switch on a water supply when hands are inserted into a wash basin, thereby avoiding the need for manual contact with any taps or switches and thus reducing the risk of crosscontamination. In one known type of unit, the washing water supplied has a hand washing detergent or disinfectant component dissolved in it, for example an iodophor.

Various systems have been developed wherein it is intended that a counter be incremented each time a worker uses a handwash station. For example, U.S. Pat. No. 5,199,118 discloses a handwash station wherein soap is first dispensed onto a user's hands, followed by rinsing water. A counter is incremented at a predetermined point in the wash cycle. The disclosed system suffers from the problem that there is no positive determination that the user has indeed washed his/her hands fully.

Similarly, the apparatus disclosed in U.S. Pat. No. 5,031,258 is based on the assumption that once a user has started a wash cycle she/he will complete it.

Recent developments in soap technology have produced liquid soaps with very low viscosity. When such soaps are used, there is a temptation for a busy worker merely to wipe off the soap on his/her clothing rather than rinsing properly.

Another problem associated with prior art handwash stations is that dirt accumulates between the station and the wall on which it is mounted. It is difficult to clean this dirt away which poses a health threat.

SUMMARY OF THE INVENTION

It is an object of the present invention to provide a handwash station which provides reliable data regarding handwashing activity.

It is another object of the present invention to provide a system wherein handwash data can be analysed centrally.

It is a further object of the present invention to provide a handwash station with improved cleanability.

According to one aspect of the present invention, there is provided a hand washing and rinsing unit for a wash basin comprising: a water dispenser; a liquid soap dispenser; a proximity sensor for detecting a user's hand or hands in a position to receive water and/or soap from the water and soap dispensers and outputting a hands present signal indicative thereof; and a controller for controlling the dispensing of water and soap in dependence on the hands present signal and recording valid hand wash events, wherein the controller responds to a hands present signal to control the water dispenser to dispense a quantity of water onto a user's hand or hands for wetting, and thereafter, on condition that the hands present signal is present during a predetermined test window, controls the soap dispenser to dispense soap onto a user's hand or hands and records a valid hand wash event.

Preferably, the control means is responsive to a hands present signal after the dispensing of soap to control the water dispenser to dispense a quantity of water onto a user's hand or hands for rinsing and wherein a valid handwash event is only recorded if rinsing water has been dispensed.

Preferably, the controller is arranged such that soap and rinsing water for a preliminary wash are dispensed immediately after said wetting water is dispensed.

Preferably, the unit includes a mixing valve for mixing soap with water, wherein the water and soap dispensers share a common outlet and soap is dispensed, premixed with water by the mixing valve.

Preferably, the dispensing of water and soap is controlled by timing relays activated by the controller in dependence on the hands present signal so that water is dispensed for a predetermined initial period, after which soap is dispensed for a predetermined period and thereafter water continues to flow for a further predetermined period or until the hands present signal is interrupted.

Preferably, the soap dispenser includes a dosing pump for driving soap therethrough.

Preferably, the unit includes an integral hand wash basin.

Preferably, the unit includes a digital display for displaying a count of valid hand wash events.

According to another aspect of the present invention, there is provided a hand washing and rinsing system including: a hand washing and rinsing unit for a wash basin comprising: a water dispenser; a liquid soap dispenser; a proximity sensor for detecting a user's hand or hands in a position to receive water and/or soap from the water and soap dispensers and outputting a hands present signal indicative thereof; a controller for controlling the dispensing of water and soap in dependence on the hands present signal and recording valid hand wash events; and electronic input means for enabling a user to enter a user code, wherein the controller responds to a hands present signal to control the water dispenser to dispense a quantity of water onto a user's hand or hands for wetting, and thereafter, on condition that the hands present signal is still present, controls the soap dispenser to dispense soap onto a user's hand or hands and records a valid hand wash event, a remote computer, and a communications link between the unit and the remote computer, wherein input user details are communicated to the remote computer from the unit via the communications link together with information regarding whether the user completed a valid hand wash event.

Preferably, the system includes a plurality of hand wash and rinsing units coupled to the remote computer by a communications link.

According to a further aspect of the present invention, there is provided a hand washing and rinsing system including: a hand washing and rinsing unit for a wash basin comprising a water dispenser; a liquid soap dispenser; a controller for controlling the dispensing of water and soap, recording valid hand wash events and periodically storing a differential count of valid hand wash events; a remote computer, and a communications link between the unit and the remote computer, wherein said differential count values are communicated to the remote computer from the unit via the communications link.

Preferably, the control means and communications link are arranged to transmit a station ID code.

Preferably, the system includes encryption means for encrypting data transmitted by the communications link.

Preferably, the communications link comprises a portable data carrier. More preferably, the portable data carrier comprises a portable computer.

According to a still further aspect of the present invention, there is provided hand washing and rinsing unit for a wash basin comprising: a housing; a water dispenser in the housing; a liquid soap dispenser in the housing; and at least one stand-off by which the housing can be mounted to a wall so as to provide access behind the housing for cleaning. Preferably, there are four stand-offs.

According to a still further aspect of the present invention, there is provided a handwash station comprising a controllable soap dispenser, a controllable water dispenser, a counter for counting handwashes, a sensor for detecting a hand in using relation to the station and a controller operable to control the soap and water dispensers according to a predetermined cycle, the cycle including at least a soap dispensing step and a rinsing water dispensing step, wherein the counter is incremented if the sensor means has detected a hand in a predetermined test window at the start of each of the soap and water dispensing steps.

Preferably, said cycle includes two soap dispensing steps.

Preferably, the station includes a memory wherein the controller is operable to store periodically a count of handwashes completed in a predetermined period.

Preferably, the station includes a visible or audible warning means, wherein the control means operates the warning means when a user should place his hand or hands so as to be detected by the sensor means.

According to a still further aspect of the present invention, there is provided a handwash system comprising a handwash station having a controller for controlling the operation of the station and communication means, and a portable programming unit having user input means and communication means for communicating with the communication means of the station, wherein, when the communication means are in operative relation, the controller is responsive to operation of the user input means to establish a handwashing program for the station.

Preferably, the communication means co-operate to provide an electrical connection between the station and the programming unit for the supply of power to the programming means from the station.

Preferably, the station includes a display and the controller is responsive to the programming unit to cause the display to display instructional or informational matter in dependence on the operation of the user input means so as to provide for the interactive establishment of a handwashing program.

Preferably, the station comprises a portable code storing unit wherein the communication means of the station is operable to read a code from the portable code storing unit.

Preferably, the station is responsive to a predetermined code being read from the portable code storing unit to perform a self-test routine.

Preferably, a data transmission means is provided for conveying data from the station's communication means to a remote station and the station includes data logging means for logging handwashes carried out using the station and said transmission means is operative to send logged data to the data transmission means. Encryption means may be provided for encrypting logged data for transmission.

The data transmission means may comprises a transmission line or a portable data carrier. The portable data carrier may be in the form of a portable computer. Alternatively, the portable data carrier may comprise a memory, configured to be written to by said communication means.

Preferably, the handwash station comprises a controllable soap dispenser, a controllable water dispenser, a counter for counting handwashes, a sensor for detecting a hand in using relation to the station and a controller operable to control the soap and water dispensers according to a predetermined cycle, the cycle including at least a soap dispensing step and a rinsing water dispensing step, the counter being incremented if the sensor means has detected a hand at the start of each of the soap and water dispensing steps.

DESCRIPTION OF THE PREFERRED EMBODIMENTS

Figure 1:
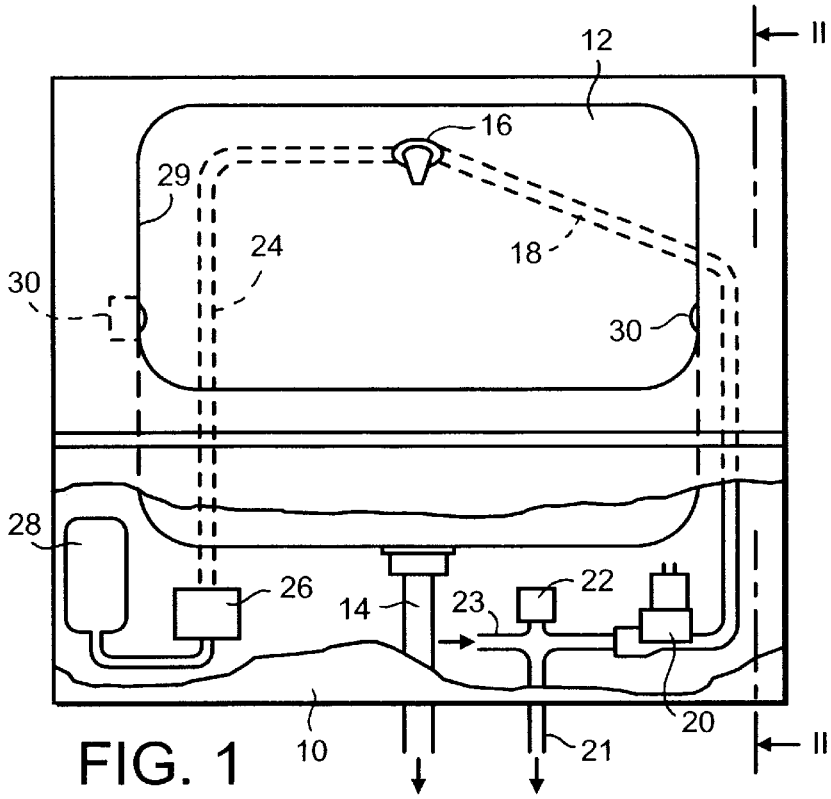
FIG. 1 is a partially cutaway front view of first a hand washing and rinsing unit in accordance with the invention.
Figure 2:
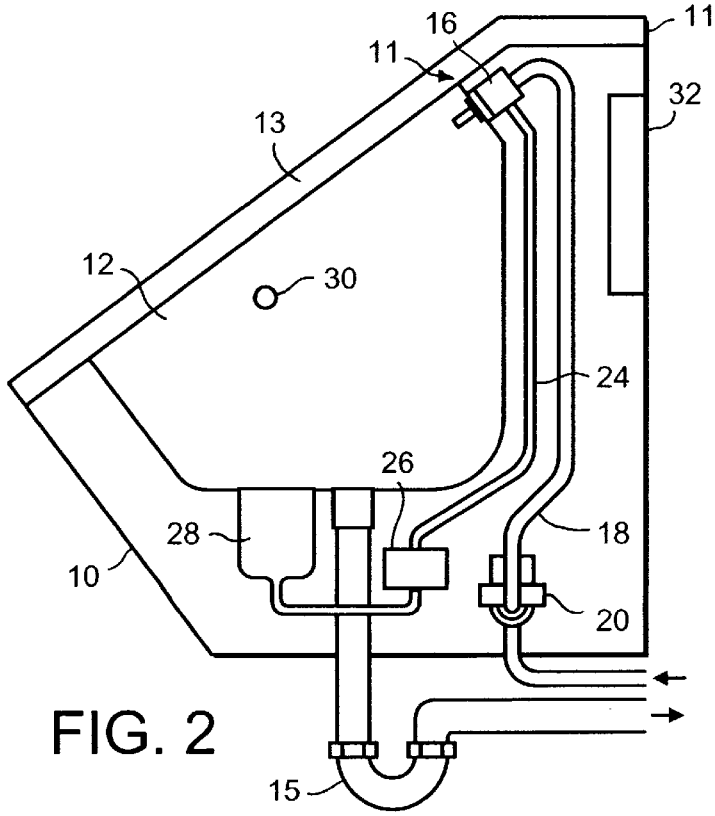
FIG. 2 is a part sectional view along the line II—II in FIG. 1.

Referring first to FIGS. 1 and 2, a hand wash unit comprises a basin 12 which may suitably be made from stainless steel but could for example be made from aluminium or glass fibre reinforced plastics. The basin is secured to a housing 10, suitably of the same material, by means of screws 11 which pass through overlapping flanges 13 on each side of the basin.

The housing 10 is provided with means (not shown) for securing it to a wall. The wash basin 12 is provided with a conventional waste water outlet 14 and sink trap 15.

The supply of water to the basin is by way of a mixer valve 16 through which passes water from an inlet pipe 18 and which is arranged when required to mix into the water a predetermined quantity of a liquid soap fed in through a conduit 24.

The water pipe 18 is fed by a cold water supply 21 and a hot water supply 23, both of which pass through a thermostatically controlled mixer 22 which can be preset to supply water to the basin at a suitable hand washing temperature such as 40 to 50° C. The thermostatic control 22 is preferably of a fail-safe type so as to avoid scalding.

From the thermostatic mixer, the water flows at the required temperature through an electrically controlled solenoid valve 20 which is arranged to turn the supply on and off in response to control mechanisms to be described in more detail below.

Liquid soap is supplied from a container 28 to the inlet conduit 24 by means of an electrically operated chemical dosing pump 26 which is arranged to be switched on and off by a central control system described below, in accordance with a predetermined program.

On each of the inner side walls 29 of the basin there is provided an infrared proximity sensor 30. Between them, these two sensors can detect when hands are inserted into the basin and send an electrical signal to the central control system to switch on the water supply.

The central control for the system, generally indicated by 32, may suitably be provided on a printed circuit board secured to the rear wall of the unit, with suitable protection against water leaks.

The operation of the system will now be described in more detail with reference to FIG. 3.

Figure 3:
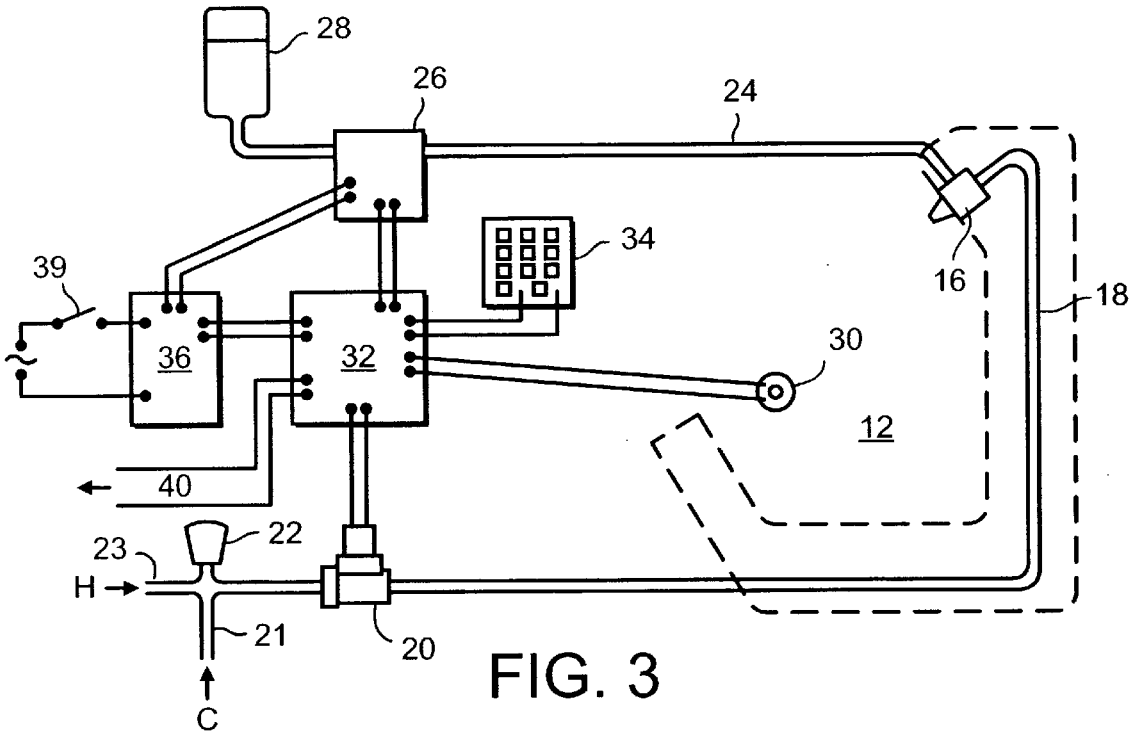
FIG. 3 is a schematic diagram showing how the parts of the system of FIGS. 1 and 2 interconnect.

As shown in FIG. 3, the central control unit 32 is supplied by a mains transformer 36 which in turn is connected to an ordinary AC mains supply. The transformer also provides the power necessary for the soap dosing pump 26. Connected to the unit 32 are the dosing pump 26, a user code input panel 34, the proximity sensors 30 and the solenoid valve 20. An output line 40 from the control unit is connected to a computer with a display screen and printer.

With the system switched on at the mains by means of a main switch 39, an employee, for example in a restaurant or food processing factory, keys in a personal code number by pressing buttons on the panel 34. This code is recorded by the monitoring computer via connection 40 and the system is then set to operate. Instead of a keyboard input, the unit 34 could comprise a magnetic strip reader operated by personal user cards.

With the system activated, the employee inserts his hands into the wash basin 12, causing one or both of the proximity sensors 30 to send a signal to the control unit 32. This activates a series of timer relays and first operates the solenoid valve 20 to switch on the water supply via the mixer unit and nozzle 16.

After an initial "wetting" period of for example five to eight seconds, a second timer relay switches on the dosing pump 26 to supply liquid soap to the mixer unit 16 so that a soap solution is fed on to the users hands. The initial running period will have shown the user where the water jet is, ensuring that none of the soap need be missed and thus flushed unused down the waste pipe. The flow of soap continues for a period of for example four to six seconds. The pump 26 is then switched off but water continues to flow into the basin for a period of some 25 to 40 seconds to enable the hands to be washed properly and rinsed. If during this time the hands are withdrawn from the basin, for example to brush finger nails, the supply cycle will be interrupted, but will be started again from the same point when the hands are reinserted, dispensing water only. At the end of the washing cycle the solenoid valve 20 is switched off and the unit is ready for another user.

The whole washing cycle is monitored by the central computer via the line 40. This will record the name of the user, as indicated by the user code keyed in, and will also record the time of use. If the central computer is monitoring more than one unit (and it could of course be monitoring a large number of units throughout the building) it will also record the location of the unit used. The computer will also record the total duration of the time during which the user's hands were in the basin. If for example the user simply inserts his hands for a few seconds, not long enough to start the soap supply, he will not be recorded as having washed his hands at all. Having held his hands in the basin long enough to receive the soap solution, the user will have little choice but to hold them there long enough to rinse the soap off again.

The computer record can be monitored by the person responsible, who can for example get the computer to print out a list of "defaulters" who have either not used the system or have used it for a period insufficient to effect a proper wash.

In order to prevent the mixer unit 16 from becoming clogged with soap, for example by drying of the liquid soap during an extended period of closure, the system can be set to flush the unit through with water at predetermined intervals, for example two hours. This flushing could also if desired be set to inject into the system a dose of a suitable disinfectant so as to keep the mixer head and the waste outlet free from microbial contamination.

Figure 4:
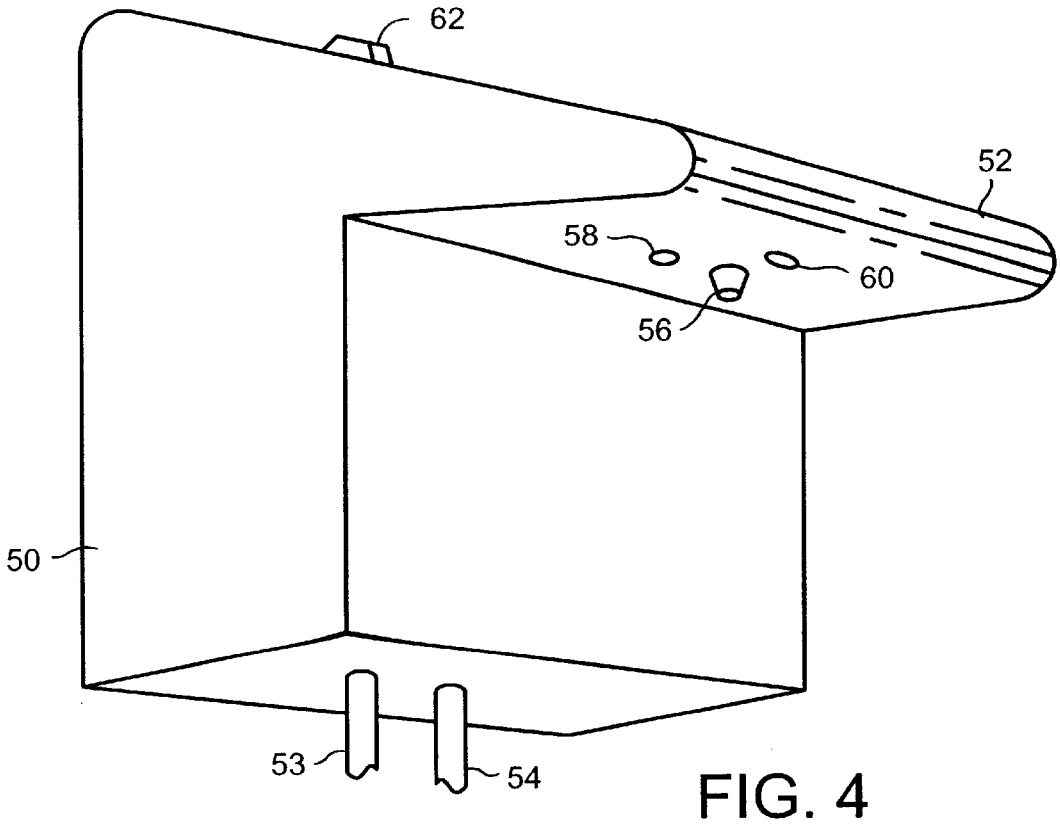
FIG. 4 is a perspective view of a second embodiment of the invention.

FIG. 4 shows a perspective view from below of a simplified wash and rinse unit in accordance with a second embodiment of the invention. This unit is designed to be positioned above a separate wash hand basin, which may be of conventional design. The unit comprises a housing 50 containing the soap supply, valves and other components, which may be broadly as described in connection with FIGS. 1 to 3. The housing has a forwardly projecting hood 52 on the underside of which are provided a water outlet 56, a soap dispensing outlet 58 and an infrared sensor 60. It will be noted that in this case the soap and water are supplied separately, albeit through adjacent outlets, rather than through a mixing valve. They are however sufficiently close to ensure that if the hands are placed below the water outlet they will also catch the soap when it is dispensed.

Pipes 53 and 54 entering the housing at the bottom supply hot and cold water to the device.

Positioned on the top of the housing is a digital counter 62, arranged to register one wash each time the soap dispenser operates.

As in the case of the embodiments of FIGS. 1 to 3, when hands are positioned below the water outlet (or water dispenser) 56, the infrared proximity sensor switches on the water supply through the outlet 56, the water being maintained at a suitable temperature such as 40°–50° C. by a thermostatic control. When the water has run for a period of a few seconds, suitably for 5 to 8 seconds, a valve is automatically actuated to dispense a measured quantity of liquid soap through the outlet (or soap dispenser 58. Once this has happened, and the user has soap on his hands, the counter 62 registers one wash as having taken place since the flow of water will continue and the user will have to keep his hands under the water supply until the soap has been washed off.

A warning light may be provided, to be illuminated when the soap is dispensed.

In order to ensure that soap is always available, the soap reservoir, which may suitably hold 3 to 5 liters of liquid soap, preferably incorporates a detector arranged to be actuated when the soap level falls below a preset minimum such as 0.5 liters. The detector can be arranged to operate a low soap warning light to alert staff to top up the soap reservoir. Should the warning light be ignored and the soap reservoir run dry, the warning system may for example be arranged to flash or illuminate a verbal message, and to shut down the system so that neither soap nor water is available. Such an event preferably also triggers a signal elsewhere, for example, in the manager's office so that action can immediately be taken.

A third embodiment will now be described with reference to FIGS. 5 to 10. Features which do not differ materially from the first embodiment will not be described again for the sake of clarity.

Figure 5:
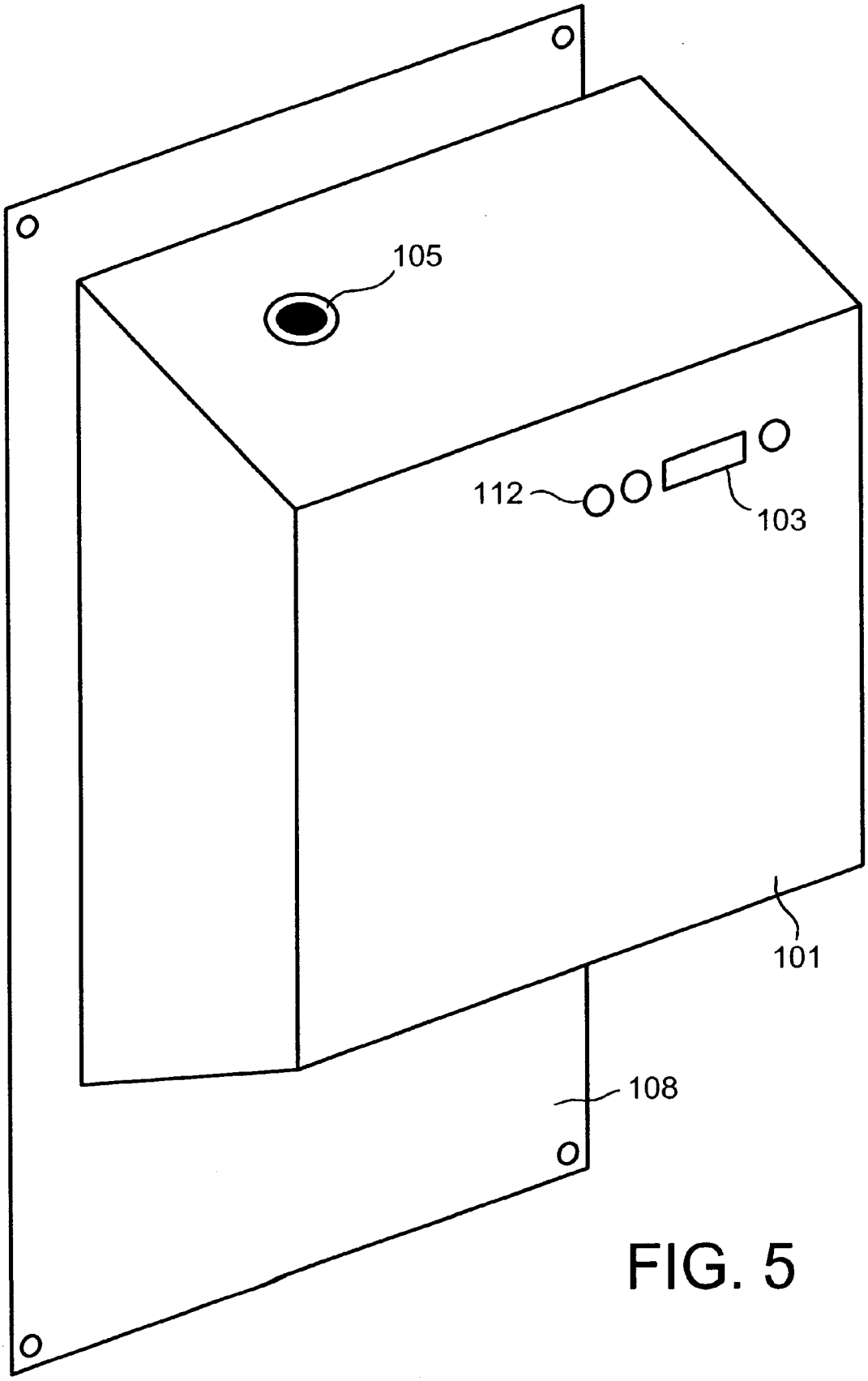
FIG. 5 is a front perspective view of a third hand washing and rinsing unit according to the present invention.
Figure 6:
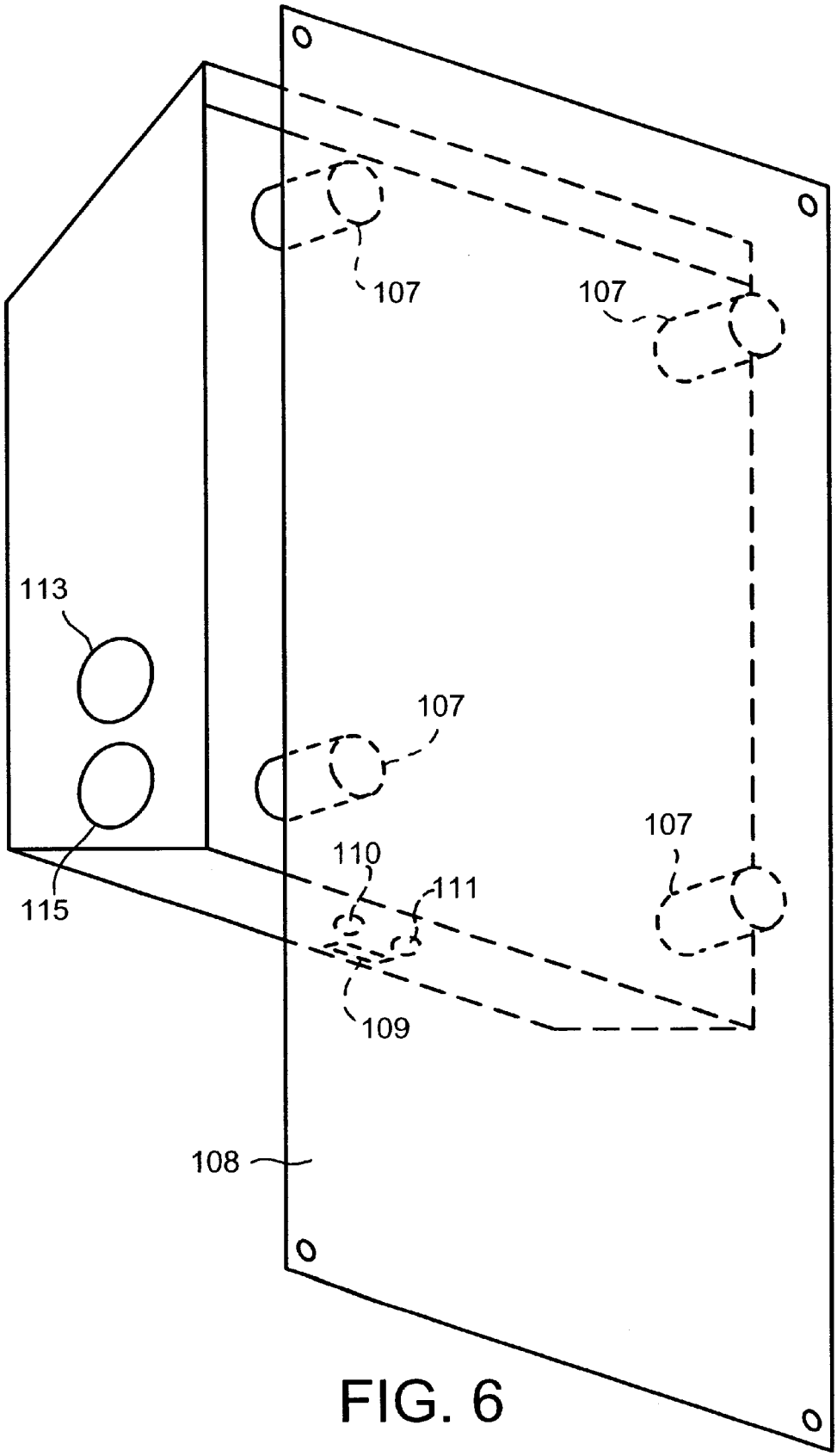
FIG. 6 is a rear perspective view of the unit of FIG. 5.

Referring to FIGS. 5 and 6, a hand wash station comprises a stainless steel cabinet 101. A display 103 is provided on the front wall of the cabinet 101 and is used to display the current hand wash count and instruction and warning messages for users. A socket 105 is provided in the top face of the cabinet 101. Four stand-offs 107 are arranged in a square on the back wall of the cabinet 101 and couple it to a backplate 108. The upper portion of the backplate 108 is substantially co-extensive with the cabinet 101 whereas the lower portion of the backplate 108 extends below the bottom of the cabinet 101. An active infrared proximity sensor 109 is provided on the bottom of the cabinet 101 together with a soap nozzle 110 and a water nozzle 111. An indicator light 112 is also mounted on the front face of the cabinet 101. Water is supplied to the station through a first aperture 113 in the lower right hand wall of the cabinet 101 and electrical power is supplied through a second aperture 115 in the lower right hand wall of the cabinet 101.

Figure 8:
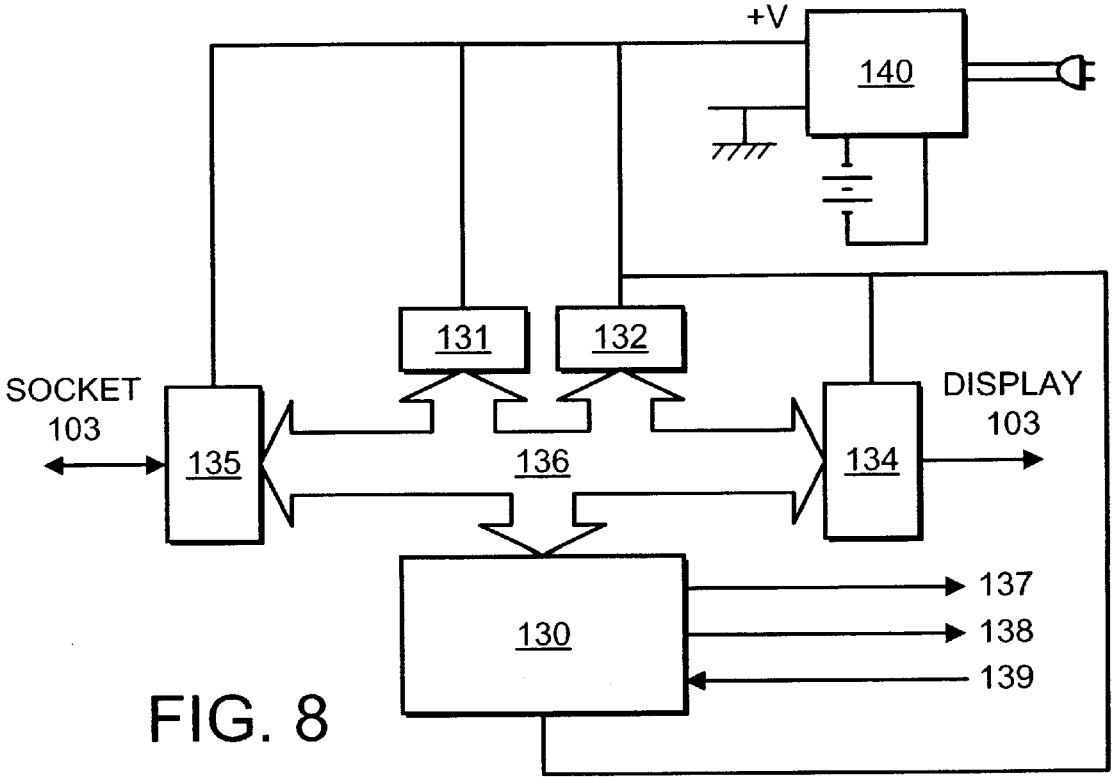
FIG. 8 is a block diagram of the control circuit of the unit of FIG. 5.

The cabinet contains a soap tank, a water valve for dispensing water, a soap pump for dispensing soap and control circuitry (FIG. 8).

Figure 7:
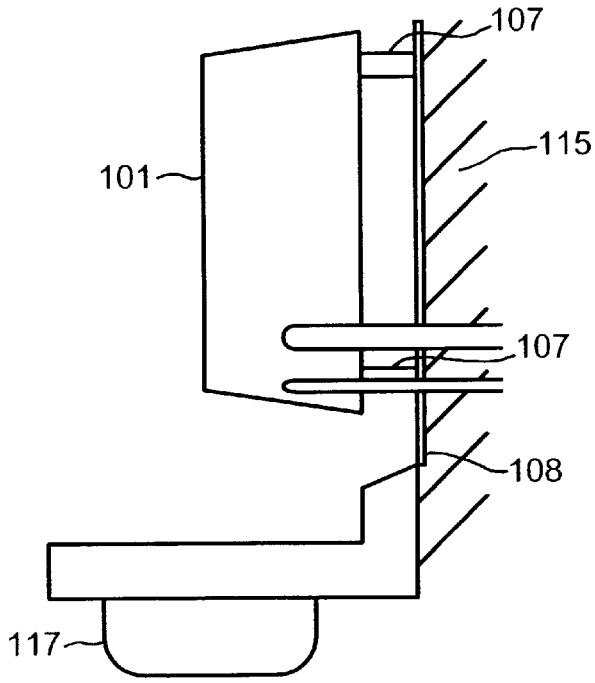
FIG. 7 is a side view of the unit of FIG. 5 installed for use.

Referring to FIG. 7, the cabinet 101 is mounted to a wall 115 by screws passing though the backplate 108. The backplate 108 is welded to the stand-offs 107 which are themselves attached to the back wall of the cabinet 101. The rest of the cabinet 101, including the soap tank, water valve, soap pump and control circuitry, is hooked onto the back wall of the cabinet 101. Thus, the station is installed by screwing the backplate 108 to the wall 115 and then hooking on the major part of the cabinet 101. A sink unit 117 is located beneath the cabinet 101. The stand-offs 107 facilitate easy cleaning behind the cabinet 101.

Referring to FIG. 8, the control circuitry of the station comprises a microprocessor 130 including a RAM, a ROM 131 for storing a control program and other permanent data, a EEPROM 132 for storing data, a display controller 134, a serial I/O circuit 135 and a bus 136 connecting the foregoing units. The display controller 134 controls the display 103 (FIG. 5) in response to control signals from the microprocessor 130. The I/O circuit 135 is coupled to the socket 105 (FIG. 5) and enables the microprocessor 130 to communicate with external devices. The microprocessor 130 has an output signal line 137 to the water valve, an output signal line 138 to the soap pump and an input signal line 139 from the proximity sensor. The operating range of the infrared sensor 109, normally 4" to 5", can be varied by varying a threshold against which the sensor signal is compared. If the range is set to too great a distance, the sensor 109 will respond to the presence of the sink 117 below the station.

A power supply unit 140 is provided for transforming and rectifying input mains power to supply the circuits in the station. A backup battery 141, providing 12 hours of normal operation in the event of main failure. The power supply unit 140 also includes battery charging circuitry for recharging the battery 141.

A preferred handwash cycle will now be described with reference to FIG. 9.

Figure 9:
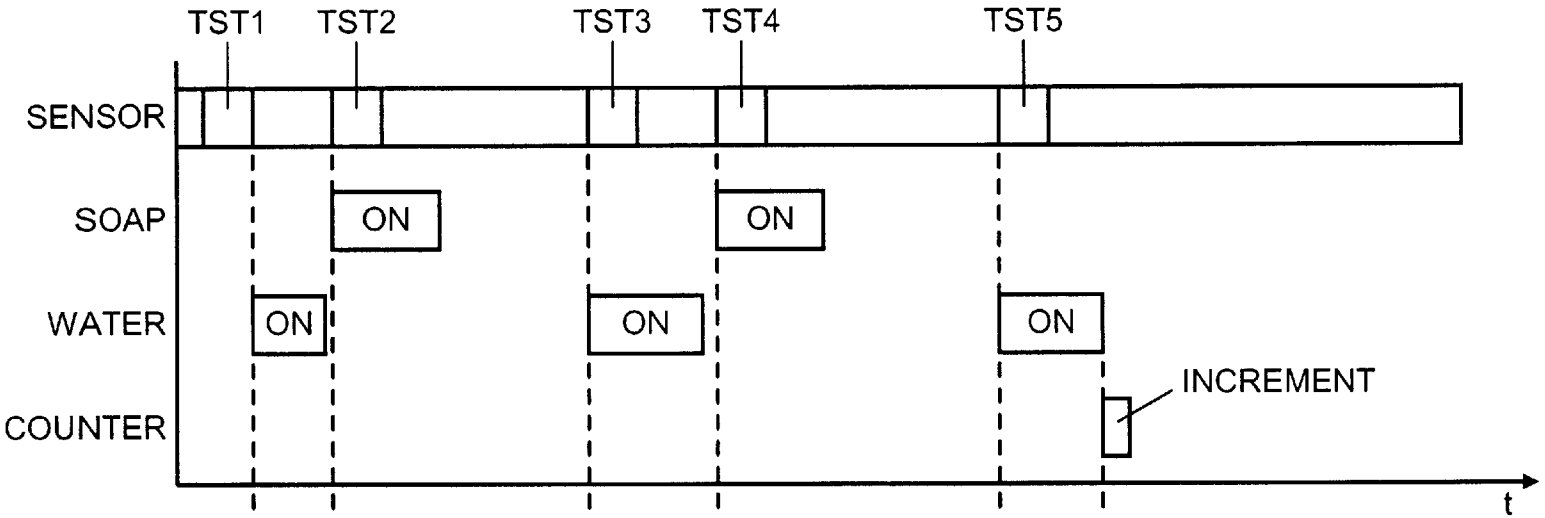
FIG. 9 is a tuning chart illustrating the operation of the unit of FIG. 5.

Referring additionally to FIG. 9, the microprocessor 130 continually monitors the infrared sensor 109 to determine whether a user has placed his or her hands in a position to receive water. If hands are detected (TST1), the microprocessor 130 initially causes the display 103 to display the massage "hands detected" and thereafter opens the water supply valve to supply wetting water to the user's hands. While the wetting water is being supplied, the microprocessor 130 causes the display 103 to indicate a countdown to the end of this supply of water. Once the supply of water has ended, the display 103 is changed to instruct the user to place his hand under the sensor 109 in order to trigger the dispensing of soap and a warning means such as the indicator light 112 is flashed, typically for 10 seconds. An audio warning alarm or any other type of warning means may also be used. If hands are then detected by the sensor 109 (TST2), the soap valve is opened and soap dispensed while the display 103 is changed to notify the user that soap is being dispensed. However, if no hands are detected at this point, the microprocessor 130 records a "hands rinsed" event and the station returns to its initial state.

Once the full dose of soap has been dispensed, the display 103 instructs the user to place his hands under the sensor 109 and provides a countdown to the supply of rinsing water, and the indicator light 112 is flashed. Towards the end of the period for the user to soap his hands, the display 103 changes to instruct the user to place his hands under the sensor 109 again in order to receive rinsing water while the indicator lamp is flashed. Once the users hands are detected (TST3), the water valve is opened and rinsing water is supplied to the users hands. The display 103 provides a countdown with the time remaining for the dispensing of rinsing water. If the users hands are not detected at this stage, the station returns to its initial state.

At the end of the rinsing period, the user is again instructed to place his hands under the sensor 109 and the indicator light 112 flashed, and once his hands are detected (TST4), a further dose of soap is supplied. The display 103 notifies the user that soap is being dispensed during this stage. If the users hands had not been detected, the station would return to its initial condition.

Once a complete dose of soap has been supplied, the display 103 instructs the user to soap his hands and indicates the time until the final dose of rinsing water is to be dispensed. Towards the end of the soaping up period, the user is instructed by the display 103 to place his hands under the sensor 109 again in order to trigger (TST5) the dispensing of the final rinsing water. At the same time, the indicator light 112 is flashed. If his hands are not detected the station returns to its initial condition.

During the dispensing of final rinsing water, the display 103 provides a countdown to the end of rinsing. At the end of the final rinsing operation, a count is incremented by the microprocessor 130. In a modified form, the count is not incremented unless hands are detected for all of the TST5 period which is preferably 70–90%, and more preferably about 80%. of the final rinsing water dispensing period. This ensures that soap is fully washed off and cannot then contaminate, for example, food stuffs that the user subsequently handles. The microprocessor 130 includes a timer function and at the end of time segments, of predetermined size (e.g. half an hour), it stores the number of washed during that segment in the EEPROM 132.

The use of test windows TST1 etc. means that it can be ensured that a user is washing his hands correctly while not requiring the user to maintain his hands under the soap and water dispensers for the whole wash cycle. Having to keep hands in the same position during washing is unnatural. It is also frustrating for a user to be briefly distracted, causing him to remove his hands, and have the hand wash apparatus restart its cycle unnecessarily.

The microprocessor 130 includes a timer function and at the end of time segments, of predetermined size (e.g. half an hour), it stores the number of washes and hands rinsed events during that segment in the EEPROM 132. The EEPROM 132 has the capacity to store approximately five weeks' data. If the EEPROM 132 becomes full, the oldest data therein is overwritten.

Any period of mains power failure is logged by the microprocessor 130 and the data transferred to the EEPROM 132 with the handwash data. In the event of impending total power failure, any data stored in the microprocessor's RAM is transferred to the EEPROM 132.

If the handwash station is not used for a predetermined period, the microprocessor 130 causes water to be dispensed for a short period so as to purge the system.

Figure 10:
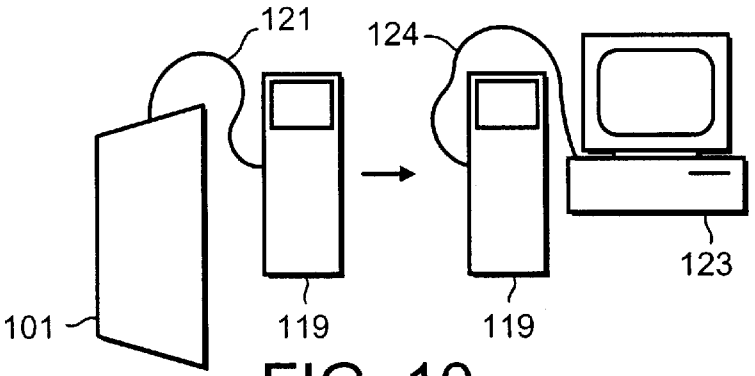
FIG. 10 illustrates the transfer of data from the unit of FIG. 5 to a central station.

Referring to FIG. 10, a supervisor is provided with a hand held computer 119. When it is desired to retrieve the hand washing frequency data for analysis, the supervisor connects the hand held computer 119 to the socket 105 on the handwash station via a cable 121. The hand held computer 119 is programmed so as to allow the supervisor to interrogate the handwash station and read the stored count values. Once all the count data has been transferred to the hand held computer 119, the supervisor can transfer it to a central station, for instance a personal computer 123. A data link 124 is formed between the hand held computer 119 and the personal computer 123 and the retrieved count data transferred from the hand held computer 119 to the personal computer 123. Once the count data has been transferred to the personal computer 123, it can be manipulated with conventional software, for instance spreadsheet programs.

The handheld computer 119 may be used to transfer hand wash count data from a plurality of hand wash stations to the personal computer 123. Also, data from handwash stations in different areas of the workplace may be transferred to the personal computer 123 using different handheld computers 119.

The microprocessor 130 is programmed to encrypt the transferred data before it is transferred.

The handheld computer 119 may also be used to program the wash cycle and reset the handwash count. Alternatively, a custom handheld unit can be used to control the wash cycle and reset the count in conjunction with the program controlling the operation of the microprocessor 130. An example of such a custom handheld unit will now be described with reference to FIG. 11.

Another embodiment will now be described which avoids the use of a handheld computer.

The handwash station of this embodiment is structurally the same as that of the first embodiment described above. Therefore, it will not be described again. Also the handwash cycle is the same.

Figure 11:
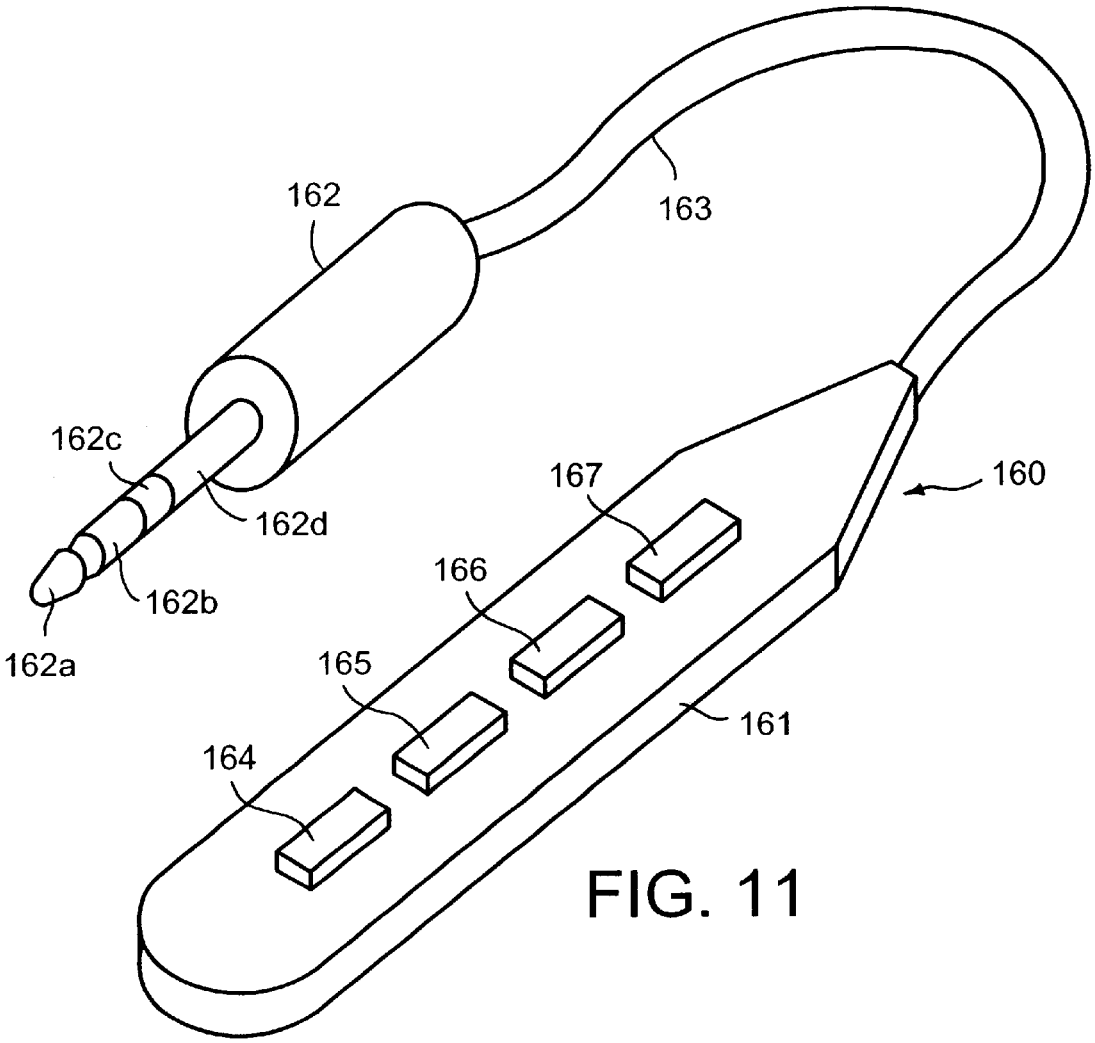
FIG. 11 shows a handheld control unit for the station of FIG. 5.

Referring to FIG. 11, custom handheld unit 160 is used to control the wash cycle and reset the count in conjunction with the program controlling the operation of the microprocessor 130. The handheld unit 160 comprises a body 161 containing four push-button switches 164, 165, 166, 167 and processing circuitry, a plug 162 for insertion into the socket 105 on the handwash station, and a lead 163 coupling the body 161 to the plug 162. Typically a manager would keep and use the handheld unit 160 and it will hereinafter be referred to as the Manager's Key. The plug 162 comprises four contacts 162*a* to 162*d*. The Managers Key 160 is powered from the station, contacts 162*a* and 162*d* being respectively for the positive and negative power supply lines. Contact 162*b* is for serial data communication to the station. Contact 162*c* is not used for the Manager's Key 160 but the equivalent contact on other keys (described below) is used for data transmissions from the station.

The microprocessor 130 repeatedly tests to establish whether the plug of a key is inserted into the socket 105. When the plug 162 is inserted into the socket 105 on the station and any of the push-button switches 164, 165, 166, 167 operated, the microprocessor 130 of the station enters a set up routine. The set up routine causes menus to be displayed by the display 103. The user navigates around the menus using the push-button switches 165, 166, 167. When the user presses one of these push-button switches 164, 165, 166, 167, the processing means generates an appropriate message signal which is then transmitted to the microprocessor 130 in the station. The microprocessor 130 identifies the message and takes the appropriate action, e.g., displaying the next menu, setting a wash cycle parameter or resetting the handwash count.

The push-button switch 164 causes a soap test message to be sent to the microprocessor 130. The microprocessor 130 responds to this message by causing the station to dispense one dose of soap.

Figure 12:
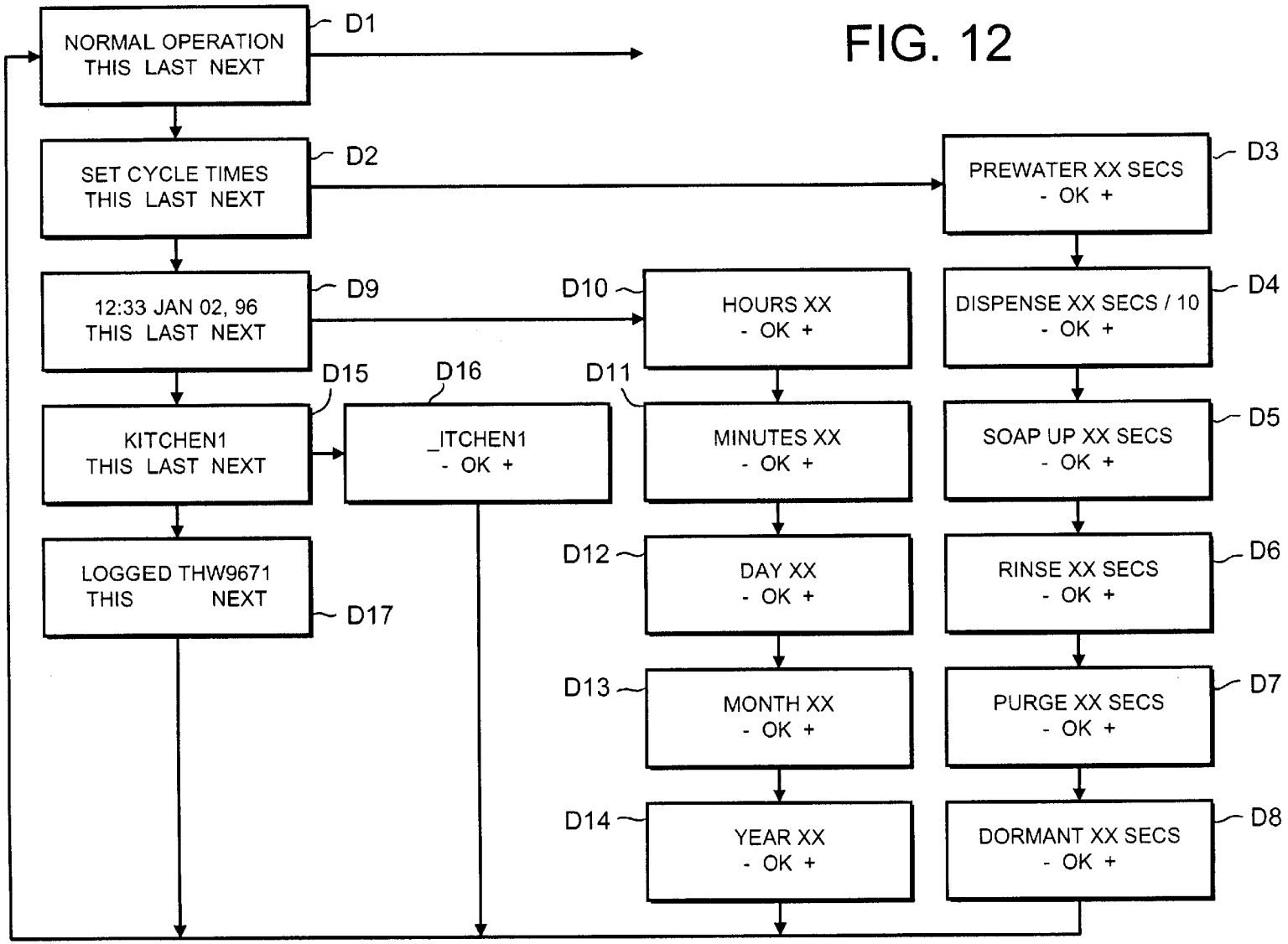
FIG. 12 illustrates features of the invention.

The set up routine will now be described with reference to FIG. 12.

Initially, the display 103 is caused to show message D1. If no further action is taken within a predetermined period, the set up routine is terminated. This means that staff are not prevented from using the station if a manager is called away during resetting and forgets to remove the Manager's Key. The set up routine is also terminated, if the THIS/OK push-button switch 166 is operated.

If the manager presses the NEXT/+ push-button switch 167, the display 103 changes to show message D2. Pressing the THIS/OK push-button switch 166 causes the station to enter a cycle time setting routine. The first message D3 of the cycle time setting routine indicates the period set for pre-soap water supply. This value can be incremented and decremented by pressing the NEXT/+ push-button switch 167 and the LAST/− push-button switch 165 respectively. Once the correct period is displayed, the THIS/OK push-button switch 166 is pressed to move on to the next period to be set. Messages D4 to D8 are displayed for setting the soap dispensing time, the soaping up time, the rinsing water supply time, the purge duration and the period between purges. Pressing the THIS/OK push-button switch 166 at display D8 brings up message D1 again. The soap dispensing time applies to both soap dispensing steps. Likewise, the soaping up and rinsing water supply times apply to both soaping up and rinsing steps in the handwash cycle.

If the NEXT/+ push-button switch 167 is pressed in response to message D2, message D9 is displayed. Pressing the THIS/OK push-button switch 166 at this point enters the station into a time and date setting routine during which messages D10 to D14 are displayed. The time and date are set in the same manner as the cycle periods.

Pressing the NEXT/+ push-button switch 167 in response to message D9 brings up message D14 which includes the units identifier "KITCHEN1". If the THIS/OK push-button switch 166 is pressed at this time, message D16 is displayed. The manager can set or alter the unit's identifier at this point. Initially, the first character of the identifier is displayed with an underscore and the manager can change the character by pressing the NEXT/+ and LAST/push-button switches 167, 165 to step through the alphabet and the numerals 0 to 9. When the THIS/OK push-button switch 166 is switched the next character is underscored and can be changed in the same manner as the first character. When the manager has stepped through each character of the identifier, the last operation of the THIS/OK push-button switch 166 causes the microprocessor 130 to store the identifier in the EEPROM 132 and message D1 is again displayed.

Finally, pressing the NEXT/+ push-button switch 167, when message D15 is being displayed, causes message D17, showing the "total hand washes" value, to be displayed. Message D1 is then brought up by pressing the NEXT/+ push-button switch 167.

If the displayed message D1, D2, D9, D15, D17 includes LAST, pressing the LAST/– push-button switch 165 returns the display to the previous message.

Once the set up routine has been completed, the microprocessor 130 stores the details of the new settings which are then transferred to the EEPROM 132 with the next batch of handwash data.

The push-button switch 164 causes a soap test message to be sent to the microprocessor 130. The microprocessor 130 responds to this message by causing the station to dispense one dose of soap.

Figure 13:
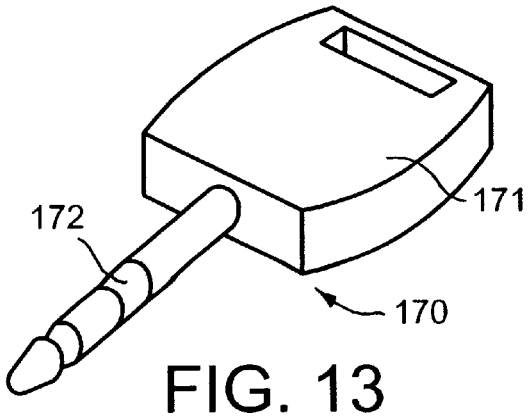
FIG. 13 illustrates features of the invention.

Referring to FIG. 13, another key 170, hereinafter the "Person-In-Charge Key", is provided to the person in charge at the site of the handwash station 101. The Person-In-Charge Key 170 comprises a body 171 and a plug 172 extending from the body 171. The plug 172 is substantially the same as that connected to the Manager's Key 160. The body 171 contains a memory and data communication circuitry. The memory is programmed with an ID code for the Person-In-Charge Key 170 which includes a portion identifying the key as a Person-In-Charge Key.

When the Person-In-Charge Key 170 is inserted into the socket 105 on the station, the microprocessor 130 detects its presence and interrogates it to read out the ID code. From the ID code, the microprocessor 130 determines that a Person-In-Charge key 170 has been inserted and performs a self-test routine. The microprocessor 130 then logs the occurrence of the self-test together with the key's ID code. This data is then transferred to the EEPROM 132 with the next batch of handwash data.

A third key, having the same construction as the Person-In-Charge Key 170, is provided to service technicians. However, the ID code, stored in the key's memory, includes a portion identifying it as a service technicians key. When a service technician attends to the station, he inserts his key into the socket 105 on the station. The microprocessor 130 detects its presence and interrogates it to read out the ID code. The microprocessor 130 determines from the ID code that the key is a technician's key and logs a service visit together with the ID code. The service visit data is transferred to the EEPROM 132 with the next batch of handwash data.

Figure 14:
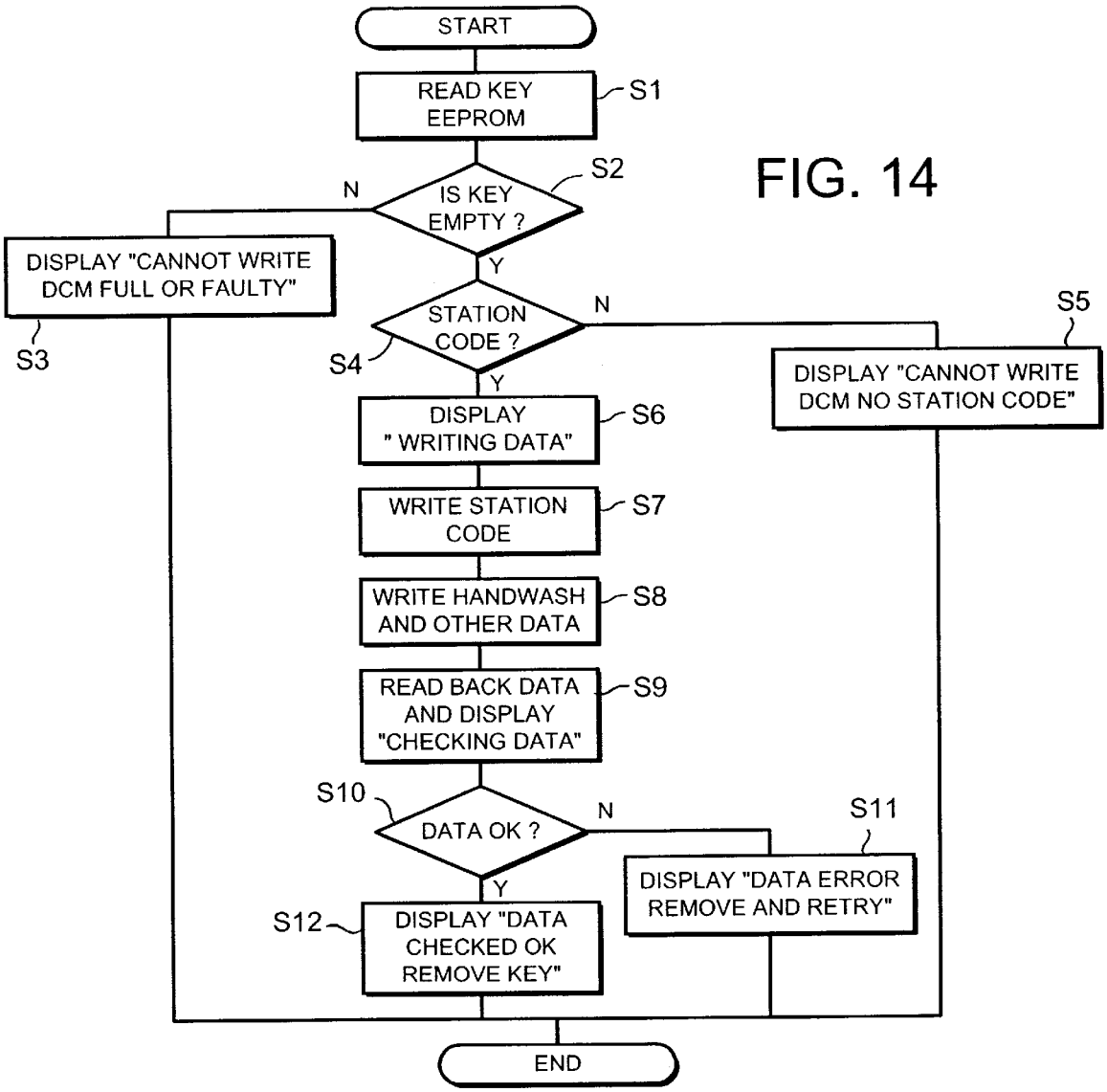
FIG. 14 illustrates features of the invention.

A further key, hereinafter the "Data Capture Key", is similar in construction to the Person-In-Charge key 170 and includes an EEPROM for storing data provided from a handwash station. The Data Capture Key is used to transfer data from the station to a remote computer for analysis. The capture of data from a station using the Data Capture Key will now be described with reference to FIG. 14.

When the microprocessor 130 detects that a Data Capture Key has been inserted into the socket 105, it first reads the EEPROM in the key to establish whether it contains any data (steps s1 and s2). If the key's EEPROM contains data, the microprocessor 130 causes the message "CANNOT WRITE KEY FULL OR FAULTY" to be displayed by the display 103 of the station (step s3). Then the microprocessor 130 exits the data capture routine.

If, at step s2, it is determined that the key's EEPROM is empty, the microprocessor 130 looks for the station's identifier in EEPROM 132 (step s4). If the microprocessor 130 cannot find a station identifier in the EEPROM 132, it causes the display 103 to display the message "CANNOT WRITE KEY NO STATION CODE" (step s5) and exits the data capture routine.

If the station's identifier is located at step s4, the microprocessor 130 causes the display 103 to display the message "WRITING DATA" and proceeds to write the station identifier to the EEPROM in the key (steps s6 and s7). Then the microprocessor 130 writes the handwash data, power failure data, service data and set up data, stored in the EEPROM 132 to the key's EEPROM (step s8).

Once step s8 has been completed, the microprocessor 130 causes the display to change to "CHECKING DATA" and reads back the data it has written to the key's EEPROM (step s9). The microprocessor 130 then compares the read back data with that stored in the EEPROM 132 (step s10). If the two sets of data do not match, the microprocessor 130 causes the message "DATA ERROR REMOVE AND RETRY" to be displayed by the display 103 (step s11) and then exits the data capture routine. On the other hand, if the stored and read back data match, the microprocessor 130 causes the display 103 to display the message "DATA CHECKED OK REMOVE KEY" (step s12) and exit the data capture routine.

Figure 15:
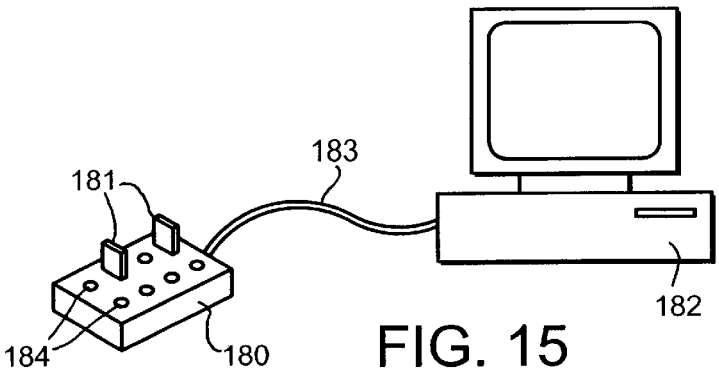
FIG. 15 illustrates features of the invention.

Referring to FIG. 15, a special adapter unit 180 is provided for interfacing Data Capture Keys 181 to a personal computer 182. The adapter unit 180 is connected to a serial port of the computer 182 by a cable 183. A plurality of sockets 184 are provided on the adapter unit 80 for receiving Data Capture Keys 181. The computer 182 is programmed to access the EEPROMs of Data Capture Keys 181 plugged into the adapter unit 180 and read out the data stored therein.

The data read from the Data Capture Keys 181 is processed by the computer to produce management reports relating to the levels of use of various handwash stations and their configurations. The self-test data is used to determine whether persons-in-charge are checking the handwash stations for which they are responsible. The service data can be used to ensure that service calls are being attended to and to identify rogue handwash stations subject to persistent or repeated faults.

What is claimed is:

1. A hand washing and rinsing unit for a wash basin comprising:

a water dispenser;

a liquid soap dispenser;

a proximity sensor for detecting a user's hand or hands in a position to receive soap and/or water from the water and soap dispensers and outputting a hands present signal indicative thereof; and a controller configured so as to cause the unit to operate in a waiting mode and in an active mode, wherein, when the unit is in said waiting mode, the controller is continuously in a state in which it is responsive to the occurrence of a hands present signal to cause:

(a) the water dispenser to dispense a quantity of water onto a user's hand or hands for wetting thereof, and (b) enter the unit into said active mode, and, when the unit is in said active mode, the controller:

(a) establishes a last soap test window after said dispensing of a quantity of water, and (b) is responsive to the occurrence of a hands present signal in said last soap test window, to cause the soap dispenser to dispense soap onto the user's hand or hands and record a valid handwash event.

2. A unit according to claim 1, wherein, when in said active mode, the controller establishes a rinsing test window immediately on completion of said dispensing of said and is responsive to the occurrence of a hands present signal during said rinsing test window to cause the water dispenser to dispense a quantity of water onto the user's hand or hands for rinsing, and wherein a valid handwash event is only recorded if rinsing water has been dispensed.

3. A unit according to claim 1, wherein, when in said active mode, the controller causes the soap and water dispensers to dispense soap and rinsing water for a preliminary wash immediately after said dispensing of water for wetting.

4. A unit according to claim 1, including warning means, wherein the controller operates the warning means when a user should place his hand or hands so as to be detected by the proximity sensor during said rinsing test window.

5. A unit according to claim 4, wherein the warning means comprises a light.

6. A unit according to claim 1, including a digital display for displaying a count of valid hand wash events.

7. A handwashing system including:

a hand washing and rinsing unit for a wash basin comprising:

a water dispenser;

a liquid soap dispenser;

a proximity sensor for detecting a user's hand or hands in a position to receive soap and/or water from the water and soap dispensers and outputting a hands present signal indicative thereof;

electronic input means for enabling a user to enter a user ID code; and a controller configured so as to cause the unit to operate in a waiting mode and in an active mode, wherein, when the unit is in said waiting mode, the controller is continuously in a state in which it is responsive to the occurrence of a hands present signal to cause;

(a) the water dispenser to dispense a quantity of water onto a user's hand or hands for wetting thereof, and (b) enter the unit into said active mode, and, when the unit is in said active mode, the controller:

(a) establishes a last soap test window after said dispensing of a quantity of water and (b) is responsive to the occurrence of a hands present signal in said last soap test window, to cause the soap dispenser to dispense soap onto the user's hand or hands and record a valid handwash event, a remote computer, and a communications link between the unit and the remote computer, wherein input user ID codes are communicated to the remote computer form the unit via the communications link together with information regarding whether the user completed a valid hand wash event.

8. A system according to claim 7, including a plurality of hand wash and rinsing units coupled to the remote computer by a communications link.

9. A system according to claim 7, wherein said communications link comprises a portable data carrier.

10. A system according to claim 9, wherein the portable data carrier comprises a portable computer.

11. A system according to claim 7, wherein, when said unit is in said active mode, the controller establishes a rinsing test window immediately on completion of said dispensing of soap and is responsive to the occurrence of a hands present signal during said rinsing test window to cause the water dispenser to dispense a quantity of water onto the user's hand or hands for rinsing, and wherein a valid handwash event is only recorded if rinsing water has been dispensed.

12. A system according to claim 7, wherein, when said unit is in said active mode, the controller causes the soap and water dispensers to dispense soap and rinsing water for a preliminary wash immediately after said dispensing of water for wetting.

13. A system according to claim 7, wherein said unit includes warning means and the controller operates the warning means when a user should place his hand or hands so as to be detected by the proximity sensor during said rinsing test window.

14. A system according to claim 13, wherein the warning means comprises a light.

15. A system according to claim 7, wherein said unit includes a digital display for displaying a count of valid hand wash events.

16. A hand washing and rinsing system including:

a hand washing and rinsing unit for a wash basin comprising:

a water dispenser;

a liquid soap dispenser;

a memory; and a controller configured to control the dispensing of water and soap by said dispensers, wherein the controller is configured to:

record valid hand wash events, establish a plurality of sequential monitoring periods of equal length, and store the number of handwash events recorded in each said monitoring period in said memory.

17. A system according to claim 16, including a remote computer and a communications link between the unit and the remote computer, wherein said stored numbers and communicated to the remote computer form the unit via the communications link and the controller and the communications link are arranged to transmit a station ID code for said unit.

18. A system according to claim 17, including encryption means for encrypting data transmitted by the communications link.

19. A system according to claim 17, wherein said communications link comprises a portable data carrier.

20. A system according to claim 19, wherein the portable data carrier comprises a portable computer.

21. A handwash station comprising:

a controllable soap dispenser;

a controllable water dispenser;

a counter for counting handwashes;

a sensor for detecting a hand in using relation to the station; and a controller responsive to said sensor and operable to control the soap and water dispensers according to a predetermined cycle, said cycle including at least a soap dispensing step and a rinsing water dispensing step, and to establish a test window at the start of each soap and water dispensing step of said cycle, wherein the controller is configured such that the counter is incremented by the controller only if the sensor outputs a signal indicating the presence of a hand during each of said test windows.

22. A station according to claim 21, wherein said cycle includes two soap dispensing steps.

23. A station according to claim 21, including a memory, wherein the controller is configured to establish a plurality of sequential monitoring periods of equal length, and store the number of handwash events counted in each said monitoring period in said memory.

24. A station according to claim 21, including warning means, wherein the controller is configured to activate the warning means at the start of each said test window.

25. A station according to claim 24, wherein the warning means is a visible warning means.

26. A station according to claim 24, wherein the warning means is an audible warning means.

27. A hand washing and rinsing unit for mounting to a wall comprising:

a housing having a back wall;

a water dispenser in the housing;

a liquid soap dispenser in the housing; and at least one mounting arm projecting rearwards from said back wall.

28. A unit according to claim 27, having four mounting arm projecting rearwards from said back wall.

29. A unit according to claim 27, including a plate coupled to said back wall by said at least one mounting arm, the plate being provided with fixing means for fixing it to a wall.

* * * * *